US009804567B2

(12) United States Patent
Stranczl

(10) Patent No.: US 9,804,567 B2
(45) Date of Patent: Oct. 31, 2017

(54) CONSTANT FORCE ESCAPEMENT MECHANISM

(71) Applicant: Nivarox-FAR S.A., Le Locle (CH)

(72) Inventor: Marc Stranczl, Nyon (CH)

(73) Assignee: Nivarox-FAR S.A., Le Locle (CH)

( * ) Notice: Subject to any disclaimer, the term of this patent is extended or adjusted under 35 U.S.C. 154(b) by 51 days.

(21) Appl. No.: 15/027,627

(22) PCT Filed: Jun. 19, 2015

(86) PCT No.: PCT/EP2015/063816

§ 371 (c)(1),
(2) Date: Apr. 6, 2016

(87) PCT Pub. No.: WO2016/012166

PCT Pub. Date: Jan. 28, 2016

(65) Prior Publication Data

US 2016/0252881 A1 Sep. 1, 2016

(30) Foreign Application Priority Data

Jul. 23, 2014 (EP) ..... 14178104

(51) Int. Cl.
*G04B 15/10* (2006.01)
*G04B 15/08* (2006.01)
*G04B 15/12* (2006.01)

(52) U.S. Cl.
CPC ..... *G04B 15/10* (2013.01); *G04B 15/08* (2013.01); *G04B 15/12* (2013.01)

(58) Field of Classification Search
CPC ..... G04B 15/00; G04B 15/08; G04B 15/10; G04B 15/12; G04B 15/14
See application file for complete search history.

(56) References Cited

U.S. PATENT DOCUMENTS 975,959 A 11/1910 Kangas
8,628,234 B2 * 1/2014 Gigandet ..... G04B 15/08 368/127

(Continued)

FOREIGN PATENT DOCUMENTS

WO 2012/010408 A1 1/2012

OTHER PUBLICATIONS

International Search Report dated Jan. 21, 2016 in PCT/EP2015/063816 filed Jun. 19, 2015.

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

A constant force escapement mechanism between an oscillator and a gear train driven by a barrel, includes a stop member cooperating with the oscillator and with toothing of a flexible, one-piece escape wheel including a pinion that meshes with an input wheel of the gear train and is connected to the toothing by flexible arms configured to store energy from the gear train and to restore energy according to a position of a detent lever, which includes a first arm cooperating with the toothing, and a second arm cooperating with the input wheel to stop or release the input wheel. The lever tilts, at each passage of a tooth of the toothing, about a pivot bearing, and the escapement mechanism is configured to be incorporated in a movement or in a watch.

12 Claims, 1 Drawing Sheet

(56) References Cited

U.S. PATENT DOCUMENTS

| | | | | |
|---|---|---|---|---|
| 2009/0168610 | A1* | 7/2009 | Gigandet | G04B 15/08 368/127 |
| 2012/0250467 | A1* | 10/2012 | Bas | G04B 15/08 368/129 |
| 2012/0250468 | A1* | 10/2012 | Bas | G04B 15/10 368/129 |
| 2013/0176829 | A1 | 7/2013 | Cusin et al. | |

* cited by examiner

CONSTANT FORCE ESCAPEMENT MECHANISM

CROSS REFERENCE TO RELATED APPLICATIONS

This is a National Phase Application in the United States of International Patent Application PCT/EP2015/063816 filed Jun. 19, 2015 which claims priority on European Patent Application No. 14178104.7 of Jul. 23, 2014. The entire disclosures of the above patent applications are hereby incorporated by reference.

FIELD OF THE INVENTION

The invention concerns a constant force escapement mechanism for timepiece movements, arranged to be inserted between, on a first upstream side, a gear train driven by an energy storage device, and on a second downstream side, an oscillator, said escapement mechanism comprising, from upstream to downstream:

an input wheel, a detent lever, an escape wheel, a stop member, wherein said stop member is arranged to cooperate downstream with a said oscillator and upstream with a first toothing comprised in said escape wheel, wherein said escape wheel is a flexible one-piece component comprising, on the one hand, a felloe carrying said first toothing and, on the other hand, a pinion permanently meshing with said input wheel which is arranged to mesh with the input of a said gear train, and said felloe and said pinion are connected to each other by flexible arms arranged to store energy from said gear train and to restore it according to the position of said detent lever.

The invention also concerns a movement comprising such an escapement mechanism, inserted between, on a first upstream side, a gear train driven by an energy storage device, and, on a second downstream side, an oscillator.

The invention also concerns a timepiece including one such movement.

The invention concerns timepiece escapement mechanisms.

BACKGROUND OF THE INVENTION

Good chronometric performance of a mechanical timepiece movement depends on the regularity of operation of the escapement mechanism comprised therein. It also depends, more particularly, on the consistency of the torque delivered to the escape wheel throughout the unwinding of the barrel or barrels.

The best results are obtained with so-called constant force escapement mechanisms, which deliver the same amount of energy at each impulse of the balance wheel. Such mechanisms are, however, complex and expensive.

SUMMARY OF THE INVENTION

The invention proposes a simple mechanism, with a very reduced number of parts, for producing an efficient, economical and compact constant force escapement mechanism.

To this end, the invention concerns a constant force escapement mechanism for a timepiece movement according to claim 1.

The invention also concerns a movement comprising such an escapement mechanism, inserted between, on a first upstream side, a gear train driven by an energy storage device, and, on a second downstream side, an oscillator.

The invention also concerns a timepiece including such a movement, characterized in that the timepiece is a watch.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
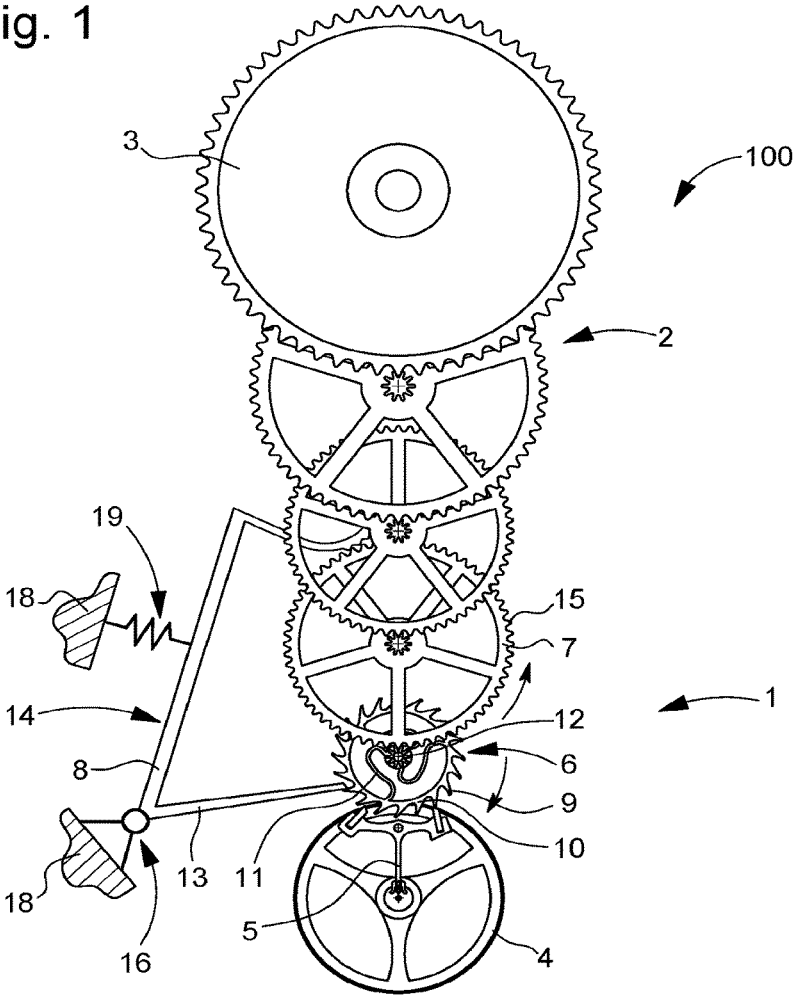
FIG. 1 shows a schematic plan view of one part of a timepiece movement, comprising, from top to bottom in the Figure: an energy storage device formed here by a barrel, meshing with a gear train in series terminating in a fourth seconds-wheel which forms, in an advantageous variant of the escapement mechanism of the invention, an input wheel for this mechanism, and which meshes with a pinion comprised in a flexible escape wheel including flexible arms between the pinion and its felloe carrying a conventional escape toothing, the latter cooperating with a stop member formed by a pallet-lever cooperating in a conventional manner with a sprung-balance, while a bridge carries a detent lever that cooperates both with the escape wheel toothing and with the input wheel toothing.

The invention proposes a simple mechanism, with a very reduced number of components, for producing an efficient, economical and compact constant force escapement mechanism, allowing a constant torque to be transmitted to the oscillator stop member, regardless of the state of charge of the energy storage device.

The invention is illustrated here in the Figures in a particular, non-limiting application, wherein the oscillator is a sprung-balance assembly, and wherein the stop member is a pallet-lever, notably a Swiss lever. The energy storage device is represented here, in a non-limiting manner, by a barrel.

The invention is intended to overcome, in this particular application, the problem of torque variation at the escape wheel depending on the state of charge of the barrel.

To reduce the number of components and ensure perfect consistency, the invention relies on the use of a flexible escape wheel, as described in the following Patent documents from the same Applicant: CH704147, CH703464, EP2455821, WO2012010408, which are incorporated herein by reference.

Advantageously, this flexible escape wheel is made in a micro-machinable material, or silicon, or quartz or an oxide or compound thereof, or an alloy derived from MEMS technology, or an alloy obtained by the "LIGA" method, or an at least partially amorphous material. In a particular embodiment, it is made of a combination of some of these materials, the material being a rigid material with a Young's modulus of more than 80000 MPa. The choice of such a material ensures the reproducibility of physical phenomena, and thus the consistency of the transmitted torque value.

Thus, the invention concerns a constant force escapement mechanism 1 for a timepiece movement 100. This escapement mechanism 1 is arranged to be inserted between, on a first upstream side, a gear train 2 driven by an energy storage device 3, notably a barrel or set of barrels, and, on a second downstream side, an oscillator 4.

Escapement mechanism 1 according to the invention includes, from upstream to downstream:

an input wheel 7, a detent lever 8, an escape wheel 6, a stop member 5.

Stop member 5 is arranged to cooperate downstream with an oscillator 4 and upstream with a first toothing 9 comprised in escape wheel 6.

This escape wheel 6 is a flexible one-piece component, comprising on the one hand a felloe 10 carrying first toothing 9, and on the other hand a pinion 12. This pinion 12 is permanently meshed with input wheel 7. This input wheel 7 is arranged to mesh with the input of such a gear train 2.

Felloe 10 and pinion 12 are connected to each other by flexible arms 11, which are arranged to store energy from gear train 2, and to restore it according to the position of detent lever 8. The one-piece escape wheel 6 can therefore store energy between its pinion 12 and its felloe 10.

Detent lever 8 stops input wheel 7. The detent is actuated by the teeth of first toothing 9 of escape wheel 6.

According to the invention, detent lever 8 includes a first arm 13, which is arranged to cooperate with first toothing 9 of escape wheel 6, and a second arm 14, which is arranged to cooperate with a second toothing 15 comprised in input wheel 7, to stop or release the latter.

Detent lever 8 is arranged to tilt, about a pivot bearing 16 comprised therein, at each passage of at least one tooth of first toothing 9 of escape wheel 6. Further, pivot bearing 16 is sized to allow the passage of a determined number of teeth of second toothing 15 of input wheel 7.

In the variant illustrated in FIG. 1, with an oscillator 4 formed by a sprung-balance with a conventional roller and impulse pin, and a stop member 5 formed by a Swiss lever, the operation is as follows:

If the system is at rest prior to the arrival of the impulse pin, flexible arms 11 of escape wheel 6 have stored energy, and input wheel 7, notably a fourth seconds-wheel, is stopped by second arm 14 of detent lever 8.

During the passage of the impulse pin, an impulse is transmitted to the balance wheel of oscillator 4. The transmitted force is provided only by flexible arms 11 of escape wheel 6. Up to that moment, input wheel 7 has not yet pivoted.

Escape wheel 6 and stop member 5 must be sized to have a large drop. During the drop, escape wheel 6 actuates the detent by releasing detent lever 8, as the impulse pin of the balance has then finished its impulse.

Input wheel 7 then recharges flexible arms 11 of escape wheel 6 with energy; escape wheel 6 no longer turns, since it is then stopped by stop member 5.

In a particular variant, detent lever 8 is mounted on a monolithic articulated structure or flexible bearing 16. This flexible bearing 16 may, if necessary, be sized to let only a determined number of teeth of input wheel 7 pass. Escape wheel 6 is thus recharged at a specific angle.

The detent is actuated at each passage of a tooth of first toothing 9 of escape wheel 6, at every other vibration.

In a particular variant, at least one of flexible arms 11 includes a stop member arranged to limit the amplitude of pivoting of input wheel 7. Escape wheel 6 is thus recharged at a specific angle. Preferably, each flexible arm 11 includes one such stop member.

In a particular variant, input wheel 7 is a fourth seconds-wheel. Specific sizing of the fourth seconds-wheel is therefore desirable to obtain a compatible number of teeth. It is also possible to have an input wheel 7 that cooperates with a fourth seconds-wheel.

Figure 2:
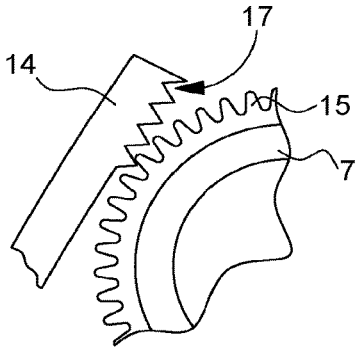
FIG. 2 shows a schematic plan view of a detail of a variant of the detent lever arm including a toothed sector cooperating with the input wheel toothing.
Figure 3:
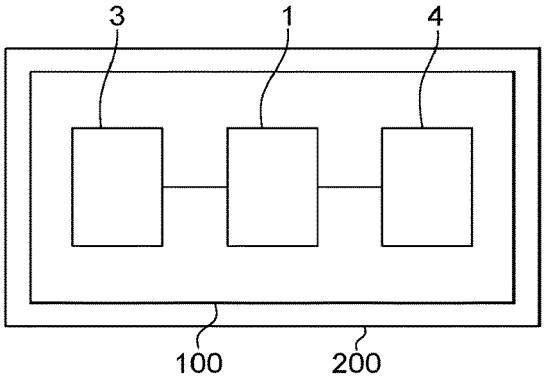
FIG. 3 shows a block diagram of a watch comprising a movement that in turn comprises an escapement mechanism according to the invention.

In a variant illustrated in FIG. 2, the second arm 14 of detent lever 8 includes a toothed sector 17, which is arranged to cooperate with the second toothing 15 of input wheel 7. Such a toothed sector 17, with a small toothing, allows for adaptation to a conventional fourth seconds-wheel; input wheel 7 may therefore be the ordinary fourth seconds-wheel, with no alteration required thereto.

In a particular variant of the invention, escapement mechanism 1 includes a bridge 18, which is in one-piece with pivot bearing 16 of detent lever 8 and with the latter.

In a particular variant of the invention, escapement mechanism 1 includes a stop member 5 which is in one-piece with bridge 18 and includes flexible bearings allowing it to pivot and arranged to limit its pivoting travel.

In a particular variant of the invention, escapement mechanism 1 includes a bridge 18 which is in one-piece with pivot bearing 16 of detent lever 8 and also with the latter, and with stop member 5 which includes flexible bearings allowing it to pivot and arranged to limit its pivoting travel.

In a particular variant of the invention, and notably in one of these one-piece versions of bridge 12 with detent lever 8 and/or stop member 5, bridge 18 includes elastic return means 19 which act on said first arm 13 and/or second arm 14 to exert a thrust or traction force or torque, depending on where they are placed with respect to the arms. It is understood that, in the alternative wherein detent lever 8 is on flexible bearing 16, the flexible bearing is capable of exerting this return force, torque or stress. If detent lever 8 pivots on a conventional pivot, elastic return means 19 should be added, notably in the form of at least one return spring.

In a particular variant of the invention, stop member 5 is a pallet-lever, notably a Swiss lever.

The invention also concerns a timepiece movement 100 including such an escapement mechanism 1, inserted between, on a first upstream side, a gear train 2 driven by an energy storage device 3, and, on a second downstream side, an oscillator 4.

In a particular variant of the invention, oscillator 4 is a sprung-balance assembly.

In a particular variant of the invention, oscillator 4 is a tuning fork.

The invention also concerns a timepiece 200 including one such movement 100. This timepiece 200 is more specifically a watch.

The invention provides a simple mechanism, which allows the oscillator to be maintained with a constant force. As a result, the maintenance of the oscillations is independent of the state of charge of the barrel or energy storage device utilised. The mechanism according to the invention is compact, and well-suited to conversion and improvement of an existing movement.

The invention claimed is:

1. A constant force escapement mechanism for a timepiece movement, configured to be inserted between, on a first upstream side, a gear train driven by an energy storage device, and on a second downstream side, an oscillator, the escapement mechanism comprising, from upstream to downstream:

an input wheel;

a detent lever;

an escape wheel;

a stop member;

wherein the stop member is configured to cooperate downstream with the oscillator and upstream with a first toothing comprised in the escape wheel, wherein the escape wheel is a flexible one-piece component comprising a felloe carrying the first toothing and a pinion permanently meshing with the input wheel which is configured to mesh with an input of the gear train, and the felloe and the pinion are connected to each other by flexible arms configured to store energy from the gear train and to restore the energy according to a position of the detent lever, wherein the detent lever includes a first arm configured to cooperate with the first toothing of the escape wheel, and a second arm configured to cooperate with a second toothing comprised in the input wheel to stop or release the input wheel, wherein the detent lever is configured to tilt, about a pivot bearing comprised therein, at each passage of at least one tooth of the first toothing of the escape wheel, and wherein the pivot bearing is sized to allow passage of a determined number of teeth of the second toothing of the input wheel.

2. The escapement mechanism according to claim 1, wherein at least one of the flexible arms includes a stop member configured to limit amplitude of pivoting of the input wheel.

3. The escapement mechanism according to claim 1, wherein the input wheel is a fourth seconds-wheel.

4. The escapement mechanism according to claim 1, wherein the second arm of the detent lever includes a toothed sector, configured to cooperate with the second toothing of the input wheel.

5. The escapement mechanism according to claim 1, wherein the escapement mechanism includes a bridge, which is in one-piece with the pivot bearing of the detent lever and with the detent lever.

6. The escapement mechanism according to claim 5, wherein the stop member is in one-piece with the bridge and includes flexible bearings allowing the stop member to pivot and arranged to limit pivoting travel of the stop member.

7. The escapement mechanism according to claim 5, wherein the bridge includes elastic return means acting on the first arm and/or second arm.

8. The escapement mechanism according to claim 1, wherein the stop member is a pallet-lever.

9. A timepiece movement comprising one the escapement mechanism according to claim 1, inserted between, on a first upstream side, a gear train driven by an energy storage device, and, on a second downstream side, an oscillator.

10. The timepiece movement according to claim 9, wherein the oscillator is a sprung-balance assembly.

11. A timepiece comprising a movement according to claim 10, wherein the timepiece is a watch.

12. The timepiece movement according to claim 9, wherein the oscillator is a tuning fork.

* * * * *